United States Patent [19]

Bartholomew et al.

[11] Patent Number: 4,771,694

[45] Date of Patent: Sep. 20, 1988

[54] BLASTING SIGNAL TRANSMISSION TUBE CONNECTOR

[75] Inventors: Stephen W. Bartholomew, Granby, Conn.; Daniel C. Rontey, Lebanon, N.J.; Clifford N. Kaiser, Granby; William J. Necker, Collinsville, both of Conn.

[73] Assignee: The Ensign-Bickford Company, Simsbury, Conn.

[21] Appl. No.: 898,052

[22] Filed: Aug. 19, 1986

[51] Int. Cl.[4] ..... C06C 5/04

[52] U.S. Cl. ..... 102/275.7; 102/275.12

[58] Field of Search ..... 102/275.2, 275.3, 275.4, 102/275.5, 275.6, 275.7, 275.8, 275.9, 275.12

[56] References Cited

U.S. PATENT DOCUMENTS

| | | | |
|---|---|---|---|
| 1,652,961 | 12/1927 | Snelling | 102/275.7 |
| 2,618,221 | 11/1952 | Lowe | 102/275.9 X |
| 2,891,476 | 6/1959 | Forsyth | 102/275.3 |
| 3,343,487 | 9/1967 | Hare et al. | 102/275.3 |
| 3,368,485 | 2/1968 | Klotz | 102/275.2 |
| 3,411,401 | 11/1968 | Harris | 102/275.8 X |
| 3,438,325 | 4/1969 | Martin | 102/314 |
| 3,706,277 | 12/1972 | Willard et al. | 102/275.4 |
| 3,734,019 | 5/1973 | Rentz et al. | 102/275.6 |
| 4,314,508 | 2/1982 | Love | 102/275.3 X |
| 4,424,747 | 1/1984 | Yunan | 102/275.2 |
| 4,481,884 | 11/1984 | Yunan | 102/275.5 X |

FOREIGN PATENT DOCUMENTS 726295 8/1953 United Kingdom .

*Primary Examiner*—David H. Brown

*Attorney, Agent, or Firm*—Hayes & Reinsmith

[57] ABSTRACT

A connector for a nondestructing blasting signal transmission tube including a housing; for engaging the extensions of at least two signal transmission tubes in adjacent relationship, the housing serving to establish a signal path permitting direct signal communication between openings in the adjacent portions of the signal transmission tubes. Preferably the connector includes a suitable device for cutting the adjacent portions of at least one of the signal transmission tubes to expose a portion of the reactive interior of the tube. Also, a method of connecting at least two signal transmission tubes by securing portions of the signal transmission tube in adjacent relationship to another; establishing a signal path between the adjacent portions of the signal transmission tubes; and cutting each of the adjacent signal transmission tubes to expose a sufficient portion of the interior of the tubes to permit direct signal communication between each of the tubes.

20 Claims, 9 Drawing Sheets

BLASTING SIGNAL TRANSMISSION TUBE CONNECTOR

BACKGROUND OF THE INVENTION

This invention relates to a connector for blasting signal transmission tubes.

In detonating a plurality of blasting charges, transmission lines are deployed from a central initiating point to send a signal to detonate the individual blasting charges. Normally, these lines consist of one or more main trunk lines Connected to a plurality of down lines.

The manner of connection of the signal transmission lines, for example, between a trunk lines and a plurality of down lines, depends on the type of transmission line utilized. Conventional self-destructing combustible fuses and detonation cords may be connected for signal transmission by tying together the line ends. In some cases supplementary charges are utilized to assure that the signal is transmitted. A supplementary charge device is disclosed in U.S. Pat. No. 4,481,884.

Non-destructing transmission tubes may also be utilized to carry a detonating signal, for example, as disclosed in U.S. Pat. No. 3,590,739. The detontaing signal transmission tube disclosed therein is sold under the trademark "Nonel" and is sometimes referred to as "shock tube". As used herein, the term "signal transmission tube" refers to any detonating or deflagrating signal transmission line comprising a flexible hollow tube which can carry a detonating or deflagrating signal along its interior, which signal does not destroy the tube. Such signal transmission tube may be any of the different available tubes, for example, shock tube having a detonating powder coated on the inner periphery of the tube, as disclosed in the aforementioned U.S. Pat. No. 3,590,739, transmission tube containing a combustible gas within the hollow tube, transmission tube containing a combustible substance carried on a line inside the tube, or a transmission tube having a deflagrating substance coated on the inside of the tube as disclosed in co-pending U.S. patent application Ser. No. 811,731, assigned to the assignee of the present application.

The term "signal" when used in connection with the aforementioned transmission tube is intended to refer to both the detonating shock wave or deflagrating flame front which is transmitted along the interior of the shock tube by combustion of the reactive substances contained therein.

Separate lines of signal transmission tube have been conventionally connected by utilizing a separate active element between adjacent tube ends, for example., a blasfing cap. The use of active elements in signal transmission tube connectors may be unsatisfactory because of noise restrictions.

The low transmission tube signal intensity also causes problems in connecting the tubes. Unless the transmission tube signal is carefully directed and controlled, it may dissipate as it passes from one tube to another and fail to initiate a signal in the second tube. In addition, the presence of contaminating elements such as water may cause the signal to dissipate. As a result, field connections of signal transmission tubes have hereto been unsatisfactory.

It is therefore an object of the present invention to provide an improved means and method for connecting signal transmission tubes.

It is a further object of the present invention to provide a means and method for connecting signal transmission tubes which has improved reliability.

It is another object of the present invention to provide a means and method for!connecting signal transmission tubes which may be practiced uuder adverse environmental conditions.

It is yet another object of the present invention to provide a means for connecting signal transmission tubes which is low in cost and essentially disposable.

It is another object of the present invention to provide a means and method for connecting signal transmission tubes which may easily be utilzed in less-skilled field installations.

Other objects will be in part obvious and in part pointcd out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

The present invention comprises, in one aspect, a signal transmission tube connector comprising a housing; means on the housing for engaging the extensions of at least two signal transmission tubes to secure portions of the tubes in adjacent relationship; and means on the housing to establish a signal path permitting direct signal communication between openings in the adjacent portions of the signal transmission tubes. Preferably the connector includes means for cutting the adjacent portion of at least one of the signal transmission tubes to expose a portion of the reactive interior of the tube.

In another aspect, the present invention comprises a method of connecting at least two signal transmission tubes by securing portions of the signal transmission tube in adjacent relationship to one another; establishing a signal path between the adjacent portions of the signal transmission tubes; and cutting each of the adjacent signal transmission tubes to expose a sufficient portion of the interior of the tubes to permit direct signal communication between each of the tubes.

As used herein, the term "direct signal communication" refers to the propagation of a transmission tube signal from one signal transmission tube to another signal transmission tube without the use of additional active elements.

DETAILED DESCRIPTION OF THE INVENTION

The nature of the transmission tube signal is such that, in practicing the present invention, attention must be paid to the positioning of the signal transmission tubes, the distance between the tube openings exposing the reactive interior portions, and the degree of enclosure about the signal transmission tube openings. In general, to establish a signal path permitting direct signal communication to take place between one transmission tube and, the degree of enclosure necessary about the transmission tube openings is inversely proportional to the spacing between the i.e., a close spacing has less need for enclosure while a relatively large spacing requires a large degree of enclosure. Beyond a certain spacing, there can be no direct signal communication between signal transmission tubes, regardless of the degree of enclosure.

Interior-exposing openings to a signal transmission tube may be made either by severing the tube completely to present a tube free end or by cutting away only a portion of the tube wall at some intermediate point between the tube ends. The size of the opening in the latter instance must be large enough to permit direct signal communication either into or out of the opening. The proper tube opening size for a particular application may be determined by simple experimentation.

The signal transmission tube adjacent portions are secured in place by means engaging the exterior of the tube, although, as will be seen in certain of the embodiments described below, auxilliary guide means may be employed which engage portions of the tube interior at the tube openings. The signal transmission tube securing means should be able to withstand the longitudinal forces created by the transmission tube signal entering or leaving the transmission tube opening, or applied in handling.

Various embodiments of the signal transmission tube connector of the present invention are illustrated in FIGS. 1-12. Like identifying numerals are used throughout the figures to identify like features. With the exception of the cutting means to be described hereinafter, the connector is preferably from a plastic or the like.

Figure 1:
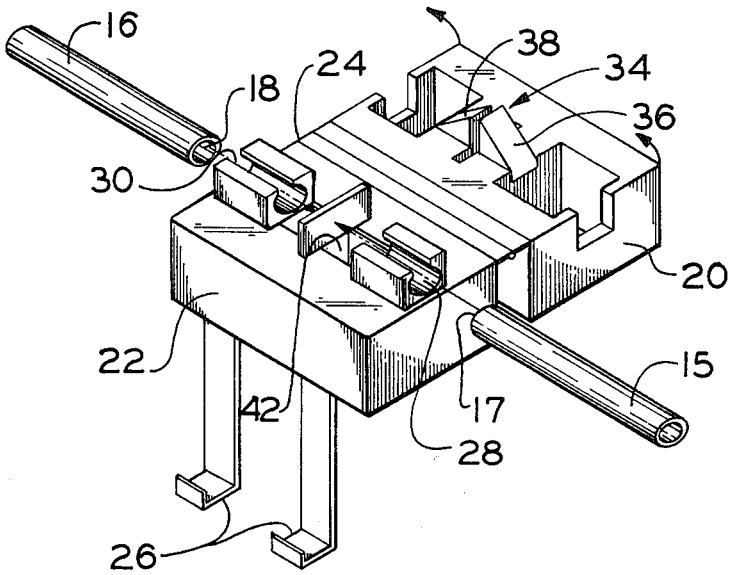
FIG. 1 is a partially exploded perspective view of a first embodiment of the transmission tube connector of the present invention.
Figure 2:
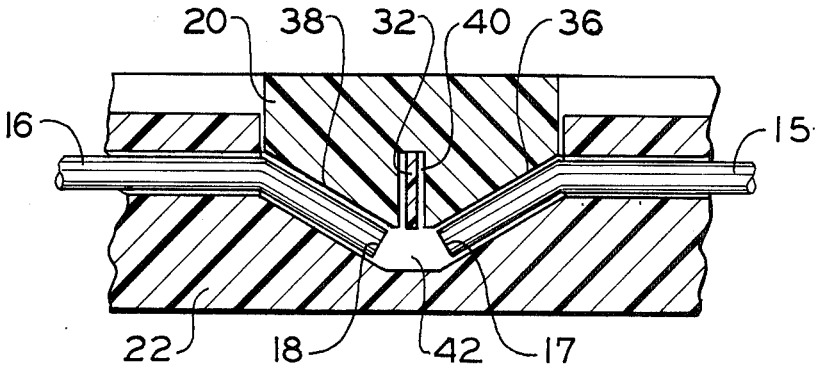
FIG. 2 is a partial longitudinal cross-section view of the embodiment of FIG. 1 in a closed position.

A first embodiment of the signal transmission tube connector is shown in FIGS. 1 and 2. Housing sections 20 and 22 make up the connector housing and are joined be a hinge 24 to permit opening and closing. Fastener clips 26 on section 22 cooperate with section 20 to secure housing sections 20, 22 in a closed position after the sections are rotated about hinge 24 in the direction of the arrow. In the housing open position shown in FIG. 1, tube slots 28, 20 are positioned on either end of housing 22 for receiving signal transmission tubes 15, 16. Retaining wall 32 is mounted between the tube slots in a plane normal to the longitudinal axes of the transmission tube slots. Guide member 34 in housing section 20 comprises ramped sections 36 and 38 on either side of a central slot 40 which corresponds to and receives retaining wall 32 when housing sections 20 and 22 are closed. Below retaining wall 22 is signal communication channel 42.

Signal transmission tubes 15, 16 are emplaced in tube slots 28, 30 with the free ends 17, 18 abutted against retaining wall 32. As housing sections 20 and 22 are closed, retaining wall 32 is received into slot 40 and ramped sections 36 and 38 urge the shock tube ends into channel 42. FIG. 2 shows signal transmission tubes 15, 16 in place after housing sections 20, 22 are closed. The spacing between the open ends 17, 18 of the signal transmission tubes 15, 16 is determined by the thickness of the retaining wall 32 and the height and angle of ramp members 36, 38. Ramp members 36, 38 cooperate with the walls of channel 42 establish a signal path between the tube free ends 17, 18 and permit direct signal communication between signal transmission tubes 15, 16.

Figure 3:
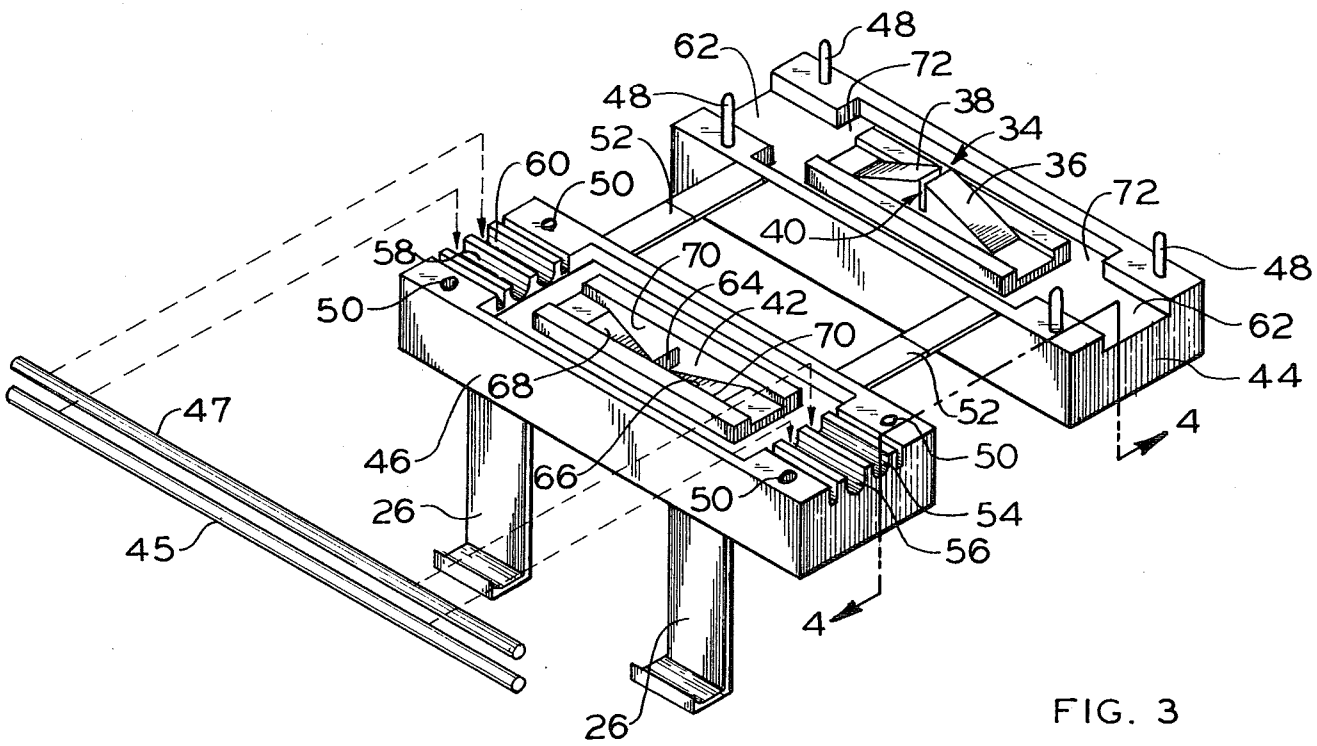
FIG. 3 is a partially exploded perspective view of a second embodiment in the transmission tube connector of the present invention.
Figure 4:
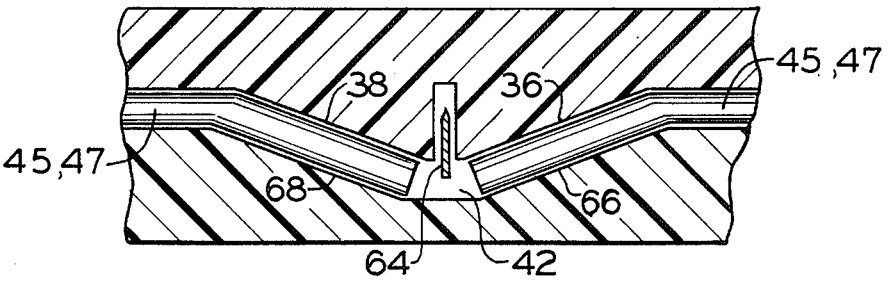
FIG. 4 is a partial longitudinal cross-section view of the embodiment of FIG. 3 in a closed position.

In FIGS. 3 and 4 there is shown a second embodiment of a signal transmission tube connector. A housing comprises housing sections 44, 46 joined by a hinge or tether 52. Guide pins 48 are received in corresponding guide holes 50 as the housing sections 44 and 16 are closed upon each other by rotation along hinge 52. Fastening clips 26 hold the housing section together in the closed position.

In the open position illustrated in FIG. 2, the housing is seen to contain slots 54, 56, 58 and 60 for receiving the signal transmission tubes 15, 17 to be connected. The tube slots are formed in opposite ends of housing section 46 and are in parallel and axially aligned relation to one another. A cooperating portion 62 of housing section 44 serves to secure the transmission tubes in the tube slot when the housing is closed. The tube slots may include clips to secure the transmission tubes 15, 47 before the housing is closed.

Between the opposing tube slots 54, 56 and 58, 60 in housing member 46 is cutting means which in this first embodiment comprises a knife-edged blade 61. The blade 64 is normal to and positioned below the tube slot axes.

Guide member 34 in housing section 44 contains a central slot 40 which corresponds to the blade 64 in housing section 46 and receives the blade 64 when the housing sections 44 and 46 are closed about hinge 52. Ramped sections 36 and 38 extend from central slot 10. When signal transmission tubes 45, 47 are placed in the tube slots across blade 64, and the housing is closed as shown in FIG. 4, guide member 24 serves to urge the transmission tubes against the knife edge of the blade 64 and cut at least a portion of the wall of the tubes. In the embodiment shown in FIG. 2, ramped sections 36 and 38 cooperate with the blade to completely sever the shock tubes.

Below blade 64 in housing section 44 is a channel 42. After the housing is closed around the shock tubes and ramped sections 36, 38 urge the shock tubes against blade 64 to cut at least a portion of the shock tube walls, the ramped sections further urge the cut-away shock tubes with the exposed interior portions into close proximity with one another on either side of the channel 42 beneath blade 64. Corresponding ramped sections 66, 68 and side walls 70 in housing section 46 form a chamber enclosing the transmission tube cut away portions when the housing is closed as seen in FIG. 4. This surrounding chamber establishes a signal path and permits direct signal communication between the reactive interior regions of the adjacent cut-away tubes. The configuration of this second embodiment permits, for example, a trunk line transmission tube 15 to be connected to a down line transmission tube 47 running between two or more blasting changes.

A gasket may be disposed in housing section 46 surrouding the blade 64 and chamber regions to provide an environmental seal for the chamber when the housing is closed. This environmental seal restricts infiltration of water and other contaminants from the region exterior of the housing into the chamber. Such contaminants, if allowed into the chamber, may interfere with direct signal communication between the signal transmission tubes.

The connector may also incorporate an absorbent or dessicating material in the housing chamber to prevent contaminating materials which may be present from interfering with signal-communication, for example, if the connector is used in the field on a rainy day. There water is the primary contaminant, the use of absorbant paper is perferred.

Figure 5:
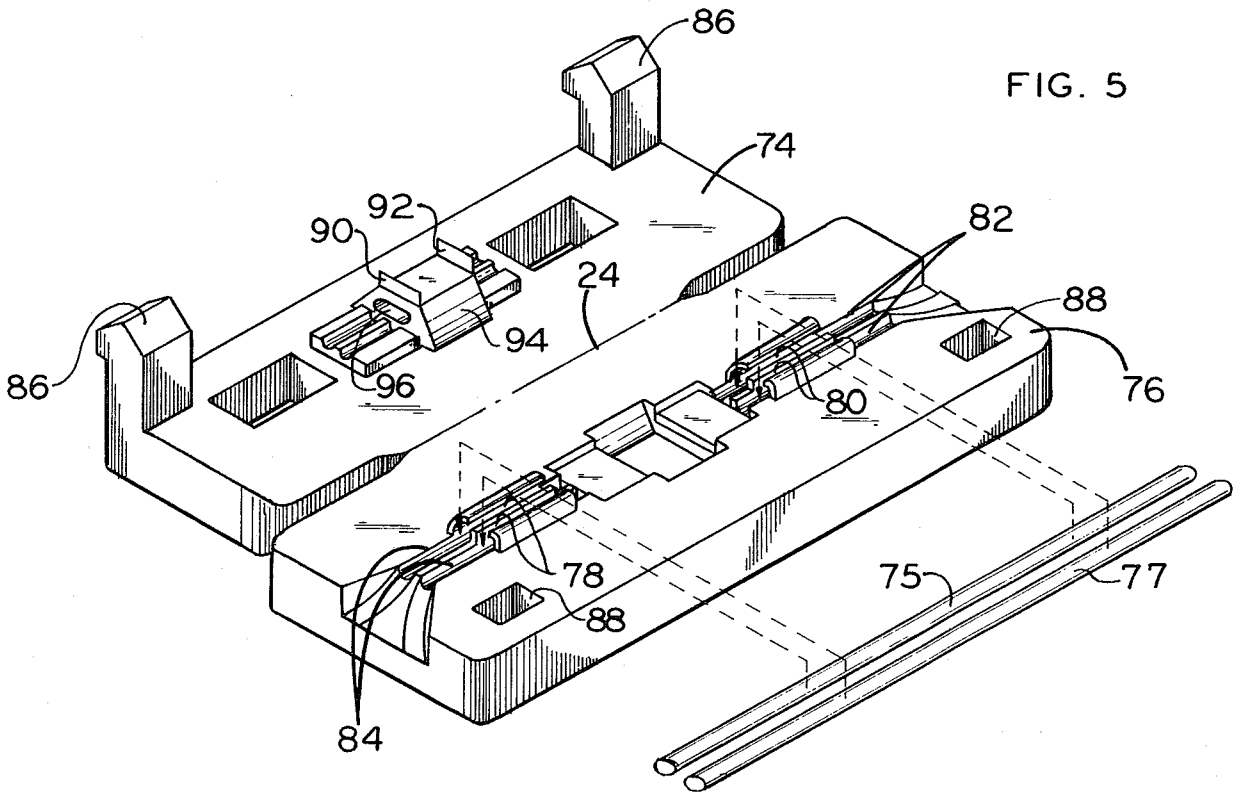
FIG. 5 is a partially exploded perspective view of a third embodiment of the transmission tube connector of the present invention.
Figure 6:
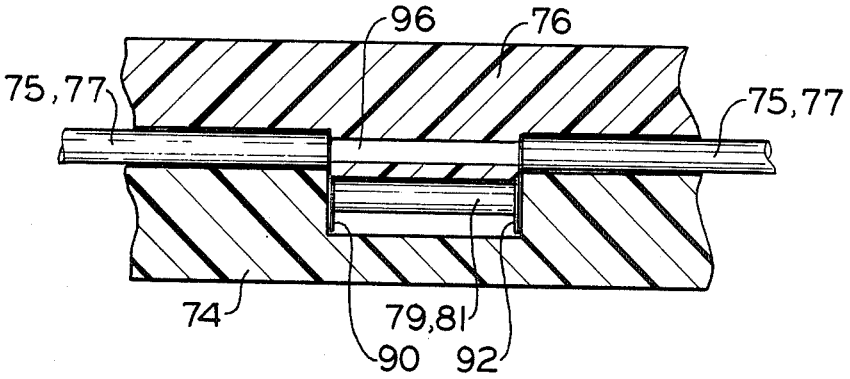
FIG. 6 is a partial longitudinal cross-section view of the embodiment of FIG. 5 in a closed position.

A third embodiment is shown in FIGS. 5 and 6. In the open position illustrated in FIG. 5, a split housing comprises sections 74, 76 joined by hinge 24, two pairs of clips 78, 80 for receiving and securing signal transmission tubes 75, 77 in tube slot pairs 82 and 84, and snaps 86 for securing housing sections 71 and 76 in a closed position. The snaps cooperate with holes 88 to guide and properly locate the housing sections 74, 76 during closing. The cutting means in this embodiment comprises two knife-edged blades 90 and 92 longitudinally spaced along the path of the signal transmission tubes when they are positioned in the housing clips 78 and 80. The blades 90 and 92 are fixed to a raised cutblock 94 on housing section 76 such that closing of housing section 76 over transmission tubes 75, 77 received in slots 82, 84 causes the blades 90, 92 to sever each tube in two longitudinallly spaced locations. As seen in FIG. 6 in a partial cross-section of the closed housing, the severed tube segments 79, 81 remain between the blades 90 and 92 and no longer form a part of the connection between the signal transmission tubes 75, 77. The cutblock 91 contains a chamber 96 below the blades and aligned directly in the path of the shock tubes when the housing is closed. The severed ends of the incoming and outgoing shock tubes are positioned directly adjacent to the cutblock chamber 96, which chamber then establishes a signal path and functions to permit direct signal communication between the interior signal propagating reactive regions of the signal transmission tubes 75, 77.

Instead of connecting only two unbroken signal transmission tubes 75, 77 as shown in this embodiment, two separate transmission tubes can be substituted for each tube shown and connected by abutting the ends of each separate pair between blades 90, 92 so that the ends are trimmed thereby.

Figure 8:
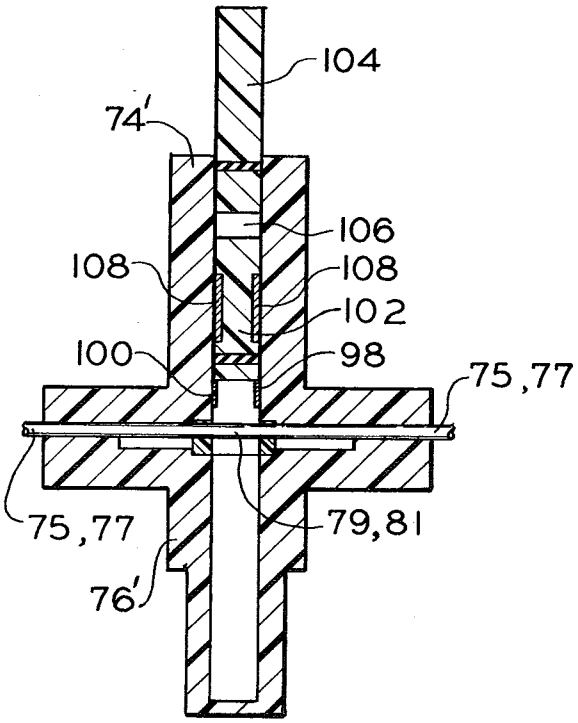
FIG. 8 is a partial longitudinal cross-section view of the embodiment of FIG. 7 in a closed position.
Figure 7:
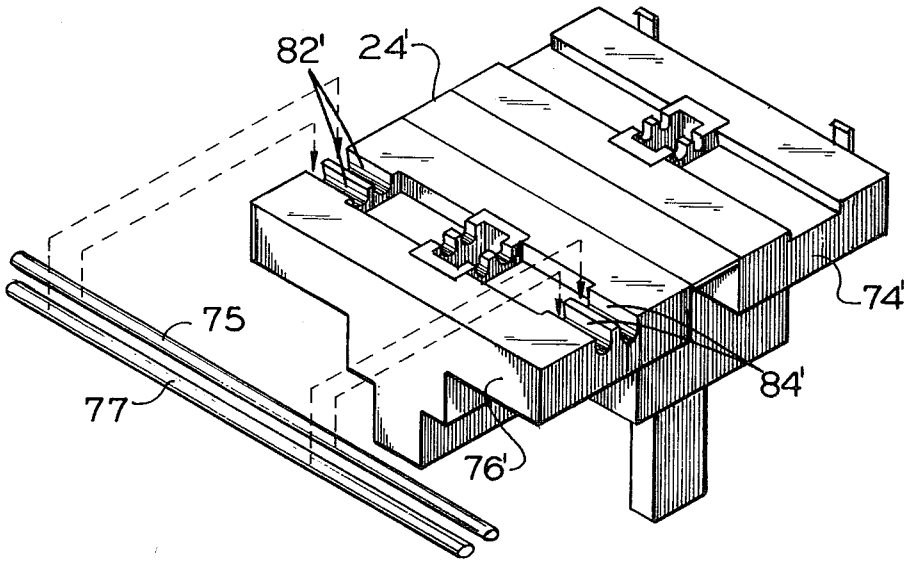
FIG. 7 is a partially exploded perspective view of a fourth embodiment of the transmission tube connector of the present invention.

In FIGS. 7 and 8 there is shown a fourth embodiment of the connector of the present invention which is a modification of the third embodiment. As seen in the open position in FIG. 7, housing sections 74', 76' again are joined by hinge 24', and contain slots 82', 84' and slot clips 78, 80 for securing signal transmission tubes 75, 77 in adjacent relationship. Any conventional fastening means may be employed for securing the housing members in a closed position. A pair of knife-edged blades 98, 100 are fixed on a cutblock 102 in a transverse position to the path of the transmssion tube. However, unlike the previous embodiment, the cutblock 102 of this fourth embodiment is mounted on a shaft 101 which is linearly slidable in a direction perpendicular to the path of the signal transmission tubes 75, 77 and the blaqe knife edge. The shaft 104 extends through housing section 74' and is operable from the housing exterior, when housing sections 74' and 76' are closed, between a retracted position where the blades are drawn away from housing section 76' and a projected position where the blades are advanced toward housing 76'. After the housing is closed, as shown in FIG. 8, the blades 98, 100 may be projected to cross the path of the transmission tube 75, 77 and so operate to sever a segment 79, 81 from the adjacent secured transmission tubes. A chamber 106 in the cutblock 102 above the blades 98, 100 is aligned with the signal transmission tube path as the shaft cutblock assembly is extended into its advanced position so as to establish a signal path and provide direct signal communication between the tubes.

In the embodiment shown in these FIGS. 7 and 8, contamination absorbent means 108, comprising absorbent paper, is affixed to the cutback 102 between the blades 98 and 100 and the cutblock chamber 106. This paper 108 serves to absorb contaminating water from the region of the severed shock tube ends as the cutblock assembly is advanced.

Figure 9:
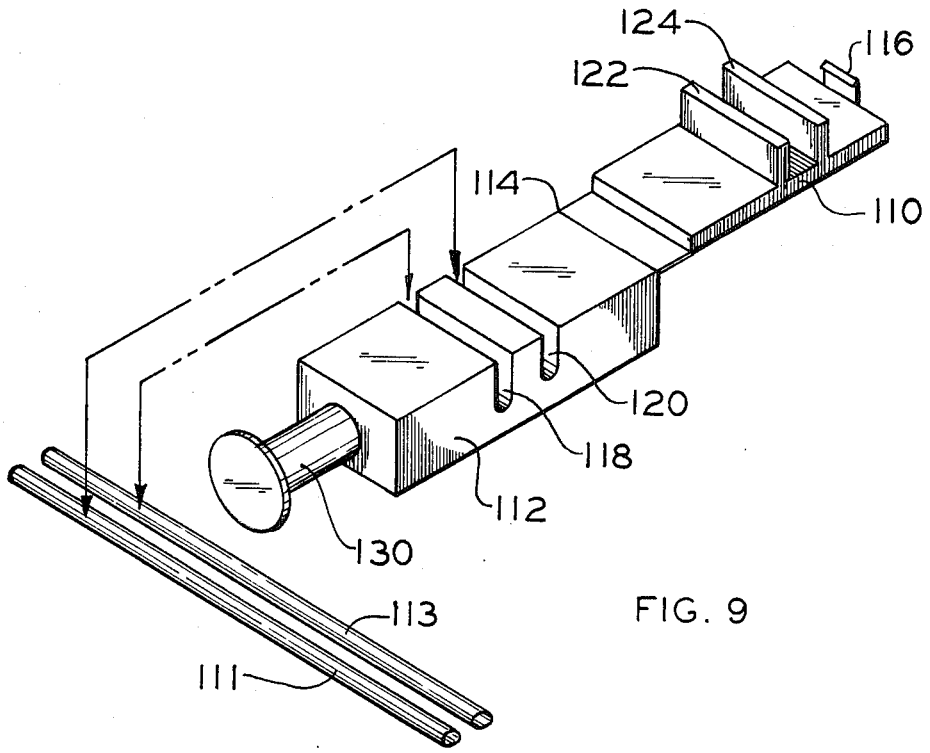
FIG. 9 is a partially exploded perspective view of a fifth embodiment of the transmission tube connector of the present invention.
Figure 10:
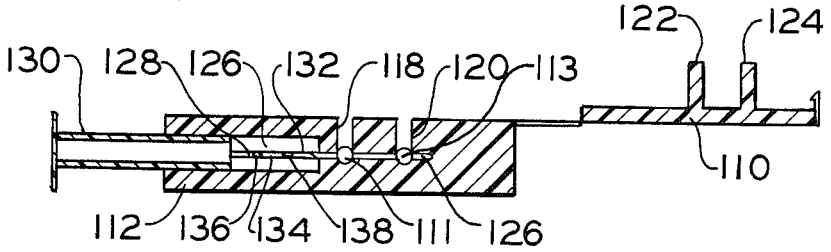
FIG. 10 is a partial longitudinal cross-section view of the embodiment of FIG. 9

A fifth embodiment of the present invention connector is illustrated in FIGS. 9 and 10. Housing sections 110 and 112 are joined by a hinge 114 and contain fastener means 116 for securing the sections in a closed position. Tube slots 118, 120 and complimentary raised portions 122, 124 are adapted to secure signal transmission tuhes 111, 113 in ad3acent relationship in the housing when sections 110, 112 are closed. A bore 126 extending from the exterior of the housing and crossing both transmission tube paths in the tube slots 118, 120 permits sliding of a needle 128 through both transmission tubes 111, 113. A plunger 130 at the exterior end of needle 128 permits advancement and retraction of the needle in the bore 126 toward and away from the tube paths. At the end of the needle opposite the plunger 130 is cutting means 132 for piercing or cutting a portion of the wall of the signal transmission tube. The cutting means 132 may comprise a pointed free end of the tube or a knife-edge rim around the free end of the needle 128. The needle 128 has a hollow portion 134 and a plurality of openings 126, 128 in the needle wall between the hollow portion 134 and the needle exterior. The needle openings 136, 138 are spaced to correspond to the spacing between the tube slots so that as the needle cutting means 132 is driven through the signal transmission tube, the needle may be advanced to a position wherein the tube openings 136, 138 are aligned with the interior portions of the respective transmission tubes 111, 112. The needle walls enclose the space between signal transmission tubes 111, 113 while the hollow portion 134 between the tube openings serves to establish a signal path and permit direct signal communication between the transmission tube interior signal propagation regions.

Figure 11:
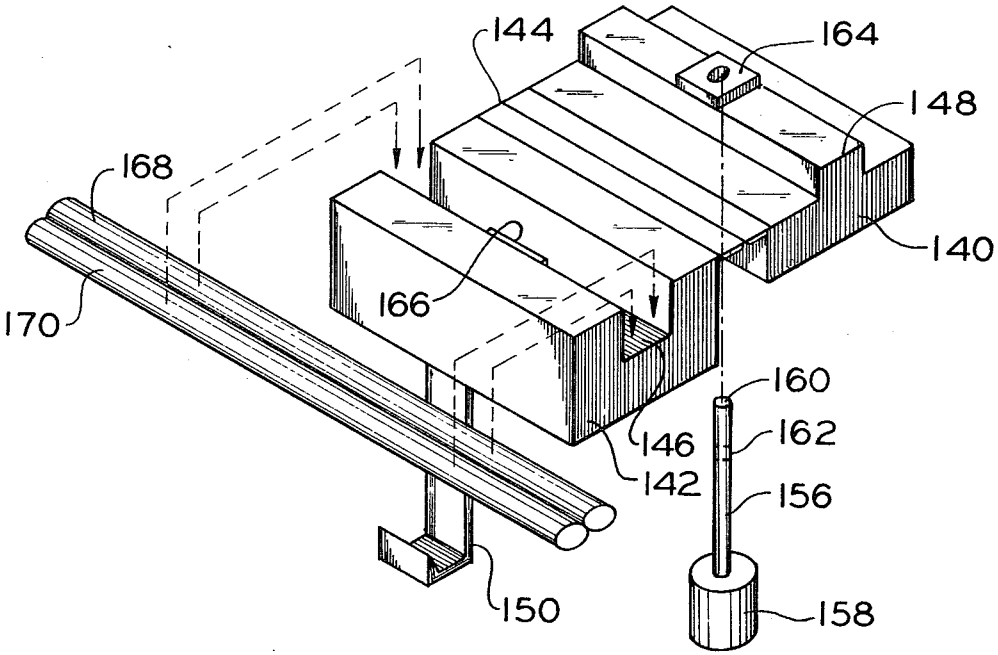
FIG. 11 is a partially exploded perspective view of a sixth embodiment of the transmission tube connector of the present invention.
Figure 12:
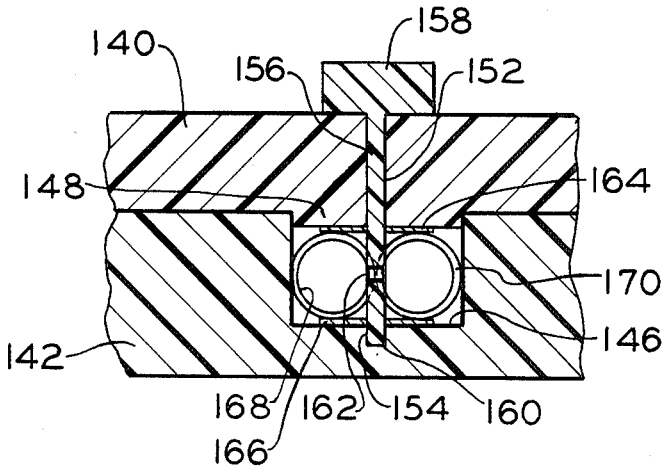
FIG. 12 is a partial longitudinal cross-section view of the embodiment of FIG. 11 in a closed position.

A sixth embodiment of the present invention is shown in FIGS. 11 and 12. Housing sections 140, 142 are joined by hinge 144 about which the housing is opened and closed. A single tube slot 146 receives a pair of signal transmission tubes 168, 170 in side-by-side relationship, which transmission tubes are are held in tube slot 116 by cooperating projection 148 when the housing sections are closed. Fastener 150 secures the housing in a closed position. Bores 152 and 154 extend through housing sections 140, 142, respectively, and are axially aligned when the housing is closed. The axis of bores 152, 154 extends through the path of the signal transmission tubes 168, 170 in slot 146. Needle 156 with head 158 on one end and a knife-edged rim as cutting means 160 on the opposite end is receivable within bores 152, 154 from the exterior of the housing. As cutting means 160 is projected through housing sections 140, 142, portions of the side walls of transmission tubes 168, 170 emplaced in tube slot 146 are cut away to reveal the tube interiors. Channel 162 runs through needle 156 perpendicular to the needle axis and is positioned longitudinally on needle 156 so that, when the needle is fully projected into housing sections, 140, 142, and through the side wall portions of the transmission tubes so that needle head 158 abuts the exterior of section 140, channel 162 is aligned with and between the cut-away portions of the signal transmission tubes 168, 170 to establish a signal math therebetween. Seals 161, 166 seal the exterior of needle 162 and the transmission tubes in the vicinity of the shock tube cut-away portions to facilitate direct signal communication between the adJacent signal transmission tubes.

While this invention has been described with reference to specific embodiments, it will be recognized by those skilled in the art that variations are possible without departing from the spirit and scope of the invention, and that it is intended to cover all changes and modifications of the invention disclosed herein for purposes of illustration which do not constitute departure from the spirit and scope of the invention.

Having thus described the invention, what is claimed is:

1. A signal transmission tube connector comprising:

a housing, means on said housing defining housing portions for engaging the exterior of at least two signal transmission tubes having end openings to secure portions of the tubes in adjacent relationship; and means on said housing to establish a free and unimpeded signal path between the housing portions engaging the signal transmission tubes thereby to position the openings in the adjacent portions of the signal transmission tubes.

2. The connector of claim 1 additionally comprising means for cutting the adjacent portion of at least one of the signal transmission tubes.

3. The connector of claim 1 wherein the signal path means comprises a chamber in the housing to surround the opening of a signal transmission tube located therein.

4. The connector of claim 1 wherein said signal path means comprises a hollow member connecting said openings in said signal transmission tube adjacent portions.

5. The connector of claim 1 wherein said housing comprises first and second members operable between an open position permitting insertion of the signal transmission tube adjacent portions and a closed position wherein the signal path means permits direct signal communication between the signal transmission tube adjacent portions, said housing including means to fasten said members in a closed position.

6. The connector of claim 5 additionally comprising means for environmentally sealing said signal transmission tube adjacent portions from the exterior of said housing.

7. The connector of claim 5 additionally including cutting means in said housing, said cutting means comprising a blade mounted on a shaft and slidable between an advanced and retracted position to sever said signal transmission tube adjacent portions, said cutting means being operable from the exterior of said housing.

8. The connector of claim 7 wherein said cutting means further includes a channel in said shaft to establish said signal path between said signal transmission tubes after said cutting means is advanced and said signal transmission tube adjacent portions are severed.

9. The connector of claim 5 additionally comprising a blade mounted in said first housing member to cut a wall portion of the signal transmission tubes, and means mounted in said housing member to urge the signal transmission tubes against said blade as said housing members are closed.

10. The connector of claim 9 wherein said communication mens comprises a channel below said blade in said housing.

11. The connector of claim 5 wherein said first and second members are joined by a hinge.

12. The connector of claim 11 additionally comprising means for cutting said adjacent portions of the signal transmission tube placed therein to expose a portion of the interior of said tube.

13. The connector of claim 12 wherein said cutting means comprises a hollow member having cutting means at one end for driving through the walls of said signal transmission tubes and a plurality of openings in the wall of said member, said openings being capable of alignment with the interior portions of said signal transmission tubes, said hollow member providing direct signal communication between said adjacent signal transmission tubes.

14. The connector of claim 12 wherein said cutting means is operable to cut the signal transmission tube as said housing members are closed.

15. The connector of claim 12 wherein said cutting means is operable to cut said signal transmission tubes after said housing members are closed.

16. A method of connecting at least two signal transmission tubes comprising:

securing portions of said signal transmission tubes in adjacent relation to one another;

establishing a signal path between said adjacent portions of said signal transmission tubes; and cutting each of said adjacent signal transmission tubes to expose a sufficient portion of the interior of said tubes to permit direct signal communication between each of sa1d tubes.

17. The method of claim 16 wherein said signal path is established prior to said cutting.

18. The method of claim 16 wherein said cutting is performed prior to said securing.

19. The method of claim 16 wherein said securing is performed simulataneously with said cutting.

20. The method of claim 16 wherein the exterior of the adjacent portions of said signal transmission tubes are wet and said method includes the step of removing at least a portion of the water from the adjacent portions of said signal transmission tubes after said signal path is established.

* * * * *

UNITED STATES PATENT AND TRADEMARK OFFICE

CERTIFICATE OF CORRECTION

PATENT NO. : 4,771,694

DATED : September 20, 1988

INVENTOR(S) : Stephen W. Bartholomew, Daniel Rontey, Clifford Kaiser, William Necker It is certified that error appears in the above—identified patent and that said Letters Patent is hereby corrected as shown below:

Column 3, line 64, "be a hinge" should read --by a hinge--.

Column 4, line 1, "28, 20" should read --28, 30--.

Column 4, line 9, "wall 22" should read --wall 32--.

Column 4, line 29, "16" should read --46--.

Column 4, line 35, "15, 17" should read --45, 47--.

Column 4, line 41, "15, 47" should read --45, 47--.

Column 4, line 45, "61" should read --64--.

Column 4, line 52, "10" should read --40--.

Column 4, line 55, "24" should read --34--.

Column 5, line 8, "15" should read --45--.

Column 5, line 24, "There water" should read --Where water--.

Column 5, line 32, "71 and 76" should read --74 and 76--.

UNITED STATES PATENT AND TRADEMARK OFFICE

CERTIFICATE OF CORRECTION

PATENT NO. : 4,771,694

DATED : September 20, 1988

INVENTOR(S) : Stephen W. Bartholomew, Daniel Rontey, Clifford Kaiser, and William Necker It is certified that error appears in the above—identified patent and that said Letters Patent is hereby corrected as shown below:

Column 5, line 47, "91" should read --94--.

Column 6, line 8, "blaqe" should read --blade--.

Column 6, line 36, "tuhes" should read --tubes--.

Column 6, line 37, "ad3acent" should read --adjacent--.

Column 6, line 51, "126, 128" should read --136, 138--.

Column 6, line 58, "111, 112" should read ---111, 113--.

Column 7, line 2, "116" should read --146--.

Column 7, line 24, "math" should read --path--.

Column 7, line 24, "161, 166" should read --164, 166--.

Signed and Sealed this

Twentieth Day of October, 1992

*Attest:*

*Attesting Officer*

DOUGLAS B. COMER

*Acting Commissioner of Patents and Trademarks*